US006021638A

United States Patent [19]

Hochmuth

[11] Patent Number: 6,021,638

[45] Date of Patent: Feb. 8, 2000

[54] ENGINE MANAGEMENT STRATEGY TO IMPROVE THE ABILITY OF A CATALYST TO WITHSTAND SEVERE OPERATING ENVIROMENTS

[75] Inventor: John Karl Hochmuth, Bridgewater, N.J.

[73] Assignee: Engelhard Corporation, Iselin, N.J.

[21] Appl. No.: 08/976,712

[22] Filed: Nov. 24, 1997

[51] Int. Cl.[7] ..... F01N 3/00

[52] U.S. Cl. ..... 60/274; 60/276; 60/285; 60/295; 123/326

[58] Field of Search ..... 60/274, 285, 286, 60/295, 301, 276; 123/326, 682, 295, 430

[56] References Cited

U.S. PATENT DOCUMENTS

| | | | |
|---|---|---|---|
| 4,106,464 | 8/1978 | Yamashita et al. . | |
| 4,214,307 | 7/1980 | Peterson, Jr. et al. . | |
| 4,434,769 | 3/1984 | Otobe et al. . | |
| 4,491,115 | 1/1985 | Otobe et al. . | |
| 4,539,643 | 9/1985 | Suzuki et al. . | |
| 4,729,220 | 3/1988 | Katsunori et al. . | |
| 5,524,432 | 6/1996 | Hansel | 60/274 |
| 5,622,048 | 4/1997 | Takashi et al. . | |
| 5,740,669 | 4/1998 | Kinugasa et al. | 60/285 |
| 5,809,774 | 9/1998 | Peter-Hoblyn et al. | 60/286 |
| 5,809,775 | 9/1998 | Tarabulski et al. | 60/286 |
| 5,848,529 | 12/1998 | Katoh et al. | 60/274 |

FOREIGN PATENT DOCUMENTS

| | | |
|---|---|---|
| 0 503 882 | 9/1992 | European Pat. Off. . |
| 0 503 882 A1 | 9/1992 | European Pat. Off. . |
| 0 560 991 B1 | 9/1993 | European Pat. Off. . |
| 0 669 157 A1 | 8/1995 | European Pat. Off. . |
| 08144748 | 4/1996 | Japan . |
| 09088686 | 3/1997 | Japan . |

*Primary Examiner*—Thomas Denion
*Assistant Examiner*—Binh Tran
*Attorney, Agent, or Firm*—Richard A. Negin

[57] ABSTRACT

A method and engine control strategy is described that enables improved catalyst performance after having been exposed to severe operating environments. More specifically, rhodium-containing catalysts are reactivated by being subjected to fuel-rich spikes after being exposed to high temperature, excess oxygen conditions which typically arise during programmed fuel-cut engine control strategies. Thus the present invention represents a departure from current control strategies by providing fuel-rich spikes during engine control modes when conventional practice is not to provide rich-fuel spikes.

17 Claims, 6 Drawing Sheets

ENGINE MANAGEMENT STRATEGY TO IMPROVE THE ABILITY OF A CATALYST TO WITHSTAND SEVERE OPERATING ENVIROMENTS

BACKGROUND OF THE INVENTION

1. Field of the Invention

This invention is generally related to the reactivation of catalysts, more particularly to the reactivation of catalysts through engine management strategies.

2. Related Art

Automobile manufacturers employ a number of engine management strategies in order to improve fuel economy. For engines controlled to operate at the stoichiometric air-to-fuel ratio (λ), the fuel injectors are shut down during deceleration driving modes. Such a strategy is called a "fuel-cut" or "lean-out" strategy. U.S. Pat. No. 4,214,307 describes a deceleration lean-out feature for electronic fuel management systems the disclosure of which is incorporated by reference. This feature provides for increasing the air/fuel ratio upon a deceleration. By creating this lean-out feature, breakthrough of a rich air/fuel ratio is purported to be avoided thereby lessening unbalancing and/or reduced efficiency of the catalytic converter.

Greater fuel economy benefits compared to the fuel-cut or lean-out modes are derived by operating the engine under lean, i.e., excess oxygen, air-to-fuel conditions. Here, lean operation can be employed only under certain driving modes, e.g., cruise modes; or under almost all driving modes, e.g., with a lean-burn engine.

A problem associated with automobile catalytic converters used on stoichiometrically controlled vehicles is their known susceptibility to deactivate when exposed to high temperature, excess oxygen conditions. For example, platinum crystallites are known to sinter under these conditions, thereby reducing the area available for catalysis. Rhodium crystallites oxidize to form a much lower activity rhodium oxide. In addition, rhodium reacts with materials that are used to disperse the metal such as alumina at temperatures in excess of 800° C. The resultant rhodium aluminate product is essentially inactive for catalysis of NOx.

These catalyst deactivation modes become particularly severe for automobile engines that are designed to run lean either part or all of the time such as in partial or full lean-burn modes. In fact the problem of catalyst deactivation is more pronounced as the inherent excess oxygen conditions of the lean-burn modes are more prevalent as compared with stoichiometric operation of an engine. Thus, in lean-burn environments there is more of a need for proper reactivation of the catalyst.

EP 503 882 describes an exhaust gas purification system for lean-burn engines which includes hydrocarbon injection means which is activated when NOx catalyst temperatures reach a predetermined minimum. The injected hydrocarbon is purported to be partially oxidized to form radicals at the lower NOx catalyst temperature and held within the cells of the NOx catalyst. When the NOx catalyst temperature rises, the stored hydrocarbon is released to promote high NOx purification at higher NOx catalyst temperatures. However, EP 503 882 contains no disclosure with regard to regeneration of the rhodium component of the rhodium-containing catalyst as disclosed and claimed by the present invention.

EP 580,389 describes an exhaust gas purification apparatus capable of recovering an NOx absorbent poisoned by sulfur oxides (SOx). In contrast to the present invention, EP 580,389 teaches against the use of fuel cut means, because at high temperature conditions (i.e., exhaust gas temperatures greater than 550° C.) SOx poisioning of the NOx absorbent is promoted.

The present invention offers an advance over known engine strategies in being able to reactivate the rhodium function of engine exhaust catalysts.

SUMMARY OF THE INVENTION

The present invention describes a method for the reactivation of a rhodium-containing catalyst having been exposed to high temperatures and lean-burn conditions, the reactivation comprising the step of introducing a fuel to create a fuel-rich environment thereby regenerating the rhodium component of the rhodium-containing catalyst.

Another embodiment of this invention relates to an engine control unit comprising an engine map which defines a region of engine operation that once entered and exited after a quick engine deceleration or fuel cut, a signal is generated to activate means for providing a rich-fuel spike to regenerate the rhodium component of the rhodium-containing catalyst.

Yet another embodiment of this invention is directed toward a system for controlling pollutant levels from an engine periodically or substantially operating in a lean-burn mode and comprising a rhodium-containing catalyst, the system comprising: (a) means for determining a fuel cut; (b) means for determining an inlet temperature to the catalyst; (c) means for determining λ; and (d) means for injecting a fuel or hydrocarbon to create a fuel-rich environment at the catalyst inlet to regenerate the rhodium component of the rhodium-containing catalyst after determining a fuel cut, an inlet temperature to the catalyst equal to or greater than a preselected temperature, and λ greater than 1.

Advantages of this invention enable existing NOx catalysts to be employed in partial-lean burn or full-lean burn applications. NOx catalysts are known in the art to significantly deactivate when exposed to high temperature, excess oxygen conditions. The level of deactivation is such that Nox emission standards cannot be met. Implementation of the invention places the NOx catalyst in a state whereby high pollutant conversion performance can be achieved comparable or exceeding performance observed at stoichiometric air-to-fuel ratios with the benefits of lean-burn engine fuel economy. Thus, the unexpected result is that performance nearly equivalent to that measured under thermal deactivation conditions is obtainable (i.e., recovery of catalyst performance due to oxidation deactivation is possible). Furthermore, this invention may enable conventional NOx catalysts to survive all conceivable normal operating modes for partial-lean burn vehicles, and perhaps direct injection engine vehicles.

DETAILED DESCRIPTION OF PREFERRED EMBODIMENTS

The following are definitions of terms useful in understanding the present invention:

Stoichiometric ratio—The mass of air (or oxygen) required to completely burn a unit mass of fuel to carbon dioxide and water with no oxygen left over.

Lean-burn condition—A condition where the amount of air (or oxygen) is greater than the stoichiometric ratio. Thus, this condition is characterized by having excess oxygen present after the fuel is burned (e.g., 5–10% oxygen).

Rich-burn condition—A condition where the amount of air (or oxygen) is less than the stoichiometric amount needed to combust the fuel; i.e., a fuel-rich environment or condition.

Lambda Ratio ($\lambda$)—The ratio of the actual air-to-fuel (A/F) ratio to the stoichiometric air-to-fuel ratio. When $\lambda>1$, this refers to a lean condition, when $\lambda<1$, this refers to a rich condition.

NOx Catalyst—As used herein, this term signifies a combined reduction catalyst/NOx sorbent capable of storing and reducing NOx under alternating lean-burn and rich-burn conditions.

One embodiment of the present invention is to use the engine control module to impose controlled air-to-fuel ratio excursions in order to return the NOx catalyst to its high activity condition. Specifically, whenever a condition exists that exposes the NOx catalyst to a high temperature, excess oxygen condition, the engine control module instructs the engine to impose an excess fuel spike thereby creating a regeneration environment at the NOx catalyst. The high temperature, excess oxygen condition may arise due to a programmed fuel-cut or when the rate of engine deceleration exceeds a predetermined amount. Alternatively, the engine map may include operation at lean air-to-fuel ratios under certain high speed, high-load conditions which result in a high temperature, excess oxygen condition. Such a driving mode could be programmed into a data table in the engine control module as requiring a fuel-rich excursion.

The present invention will become more apparent with reference to the following discussion.

Figure 1:
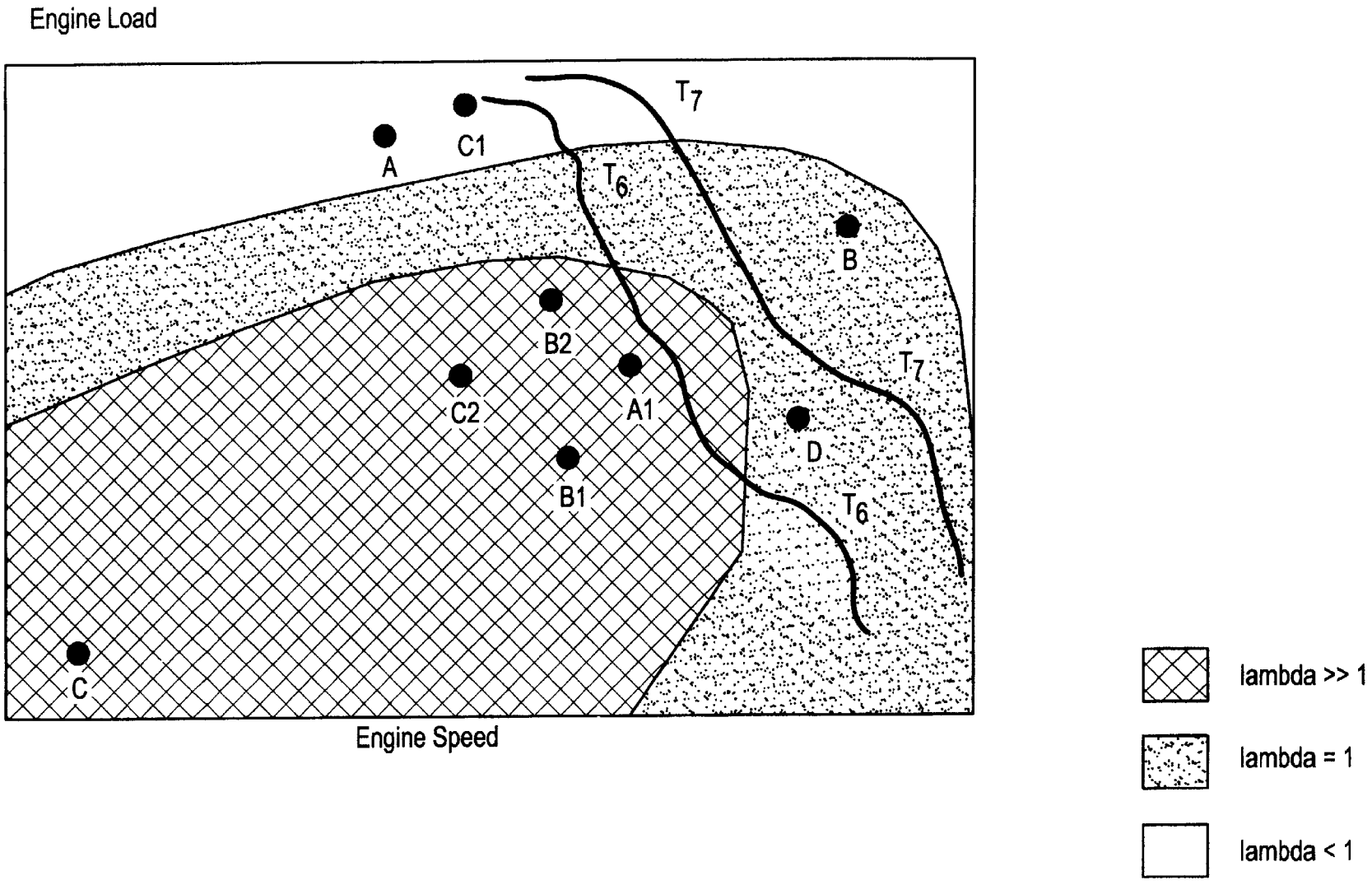
FIG. 1 is a representation of an engine map typically found in an engine control unit.

FIG. 1 is a representation of a typical engine map residing in the Engine Control Unit (ECU) of an automobile. The engine map exists as a series of data tables. One of these tables consists of a desired air-to-fuel ratio as a function of engine speed and load. Another table consists of temperatures to the NOx catalyst as a function of speed and load. The latter table might contain entries as follows:

| | Speed 1 | Speed 2 | Speed 3 | Speed 4 | Speed 5 |
|---|---|---|---|---|---|
| Load 1 | $T_1$ | $T_2$ | $T_3$ | $T_4$ | $T_5$ |
| Load 2 | $T_2$ | $T_3$ | $T_4$ | $T_5$ | $T_6$ |

-continued

| | Speed 1 | Speed 2 | Speed 3 | Speed 4 | Speed 5 |
|---|---|---|---|---|---|
| Load 3 | $T_3$ | $T_4$ | $T_5$ | $T_6$ | $T_7$ |
| Load 4 | $T_4$ | $T_5$ | $T_6$ | $T_7$ | $T_8$ |
| Load 5 | $T_5$ | $T_6$ | $T_7$ | $T_8$ | $T_9$ |

With reference to FIG. 1, the hatched area represents the engine speed/load points where the engine operates much greater than stoichiometric, i.e., $\lambda>>1$. The solid, dark area represents the region where the engine operates at the stoichiometric point, i.e., $\lambda=1$, for driveability reasons. The white area is an area where enrichment is required, either for more power or for fuel cooling, and $\lambda<1$. The bold lines running diagonally through the speed/load map are lines of constant temperature at the inlet to the NOx catalyst. For illustrative purposes, only two temperature lines are shown. These are labeled $T_6$ and $T_7$. Other lines of constant temperature could be represented by similar isotherms running approximately parallel to these lines. There exists a particular temperature above which the rich regeneration spike is imposed following a fuel cut. If this temperature is not exceeded, the spike following the fuel cut is not imposed. The labeled dark circles represent speed/load conditions that might exist under various driving scenarios. These circles will be used in the following discussion to clarify the algorithm of the invention.

Scenario 1 (Point A to A1)—Hauling a Load Up a Hill: This scenario might be experienced hauling a trailer up a steep hill. The engine is operating at an intermediate speed, but at high load. The condition might be represented by point A, for example. The ECU sets the air-to-fuel ratio to a rich power mode, and checks the expected temperature at the catalyst inlet. A flag is set indicating whether the critical temperature is exceeded. In this example, if the critical temperature is $T_6$, the flag will not be set. Once the crest of the hill is reached, the engine load decreases and the existing operating condition now changes to the speed/load point A1. During the change in engine conditions, the ECU checks other engine operating conditions, for example, the manifold pressure, to determine if there is a deceleration mode. We assume that there is no sharp deceleration in this example, and that the transition to point A1 occurs smoothly. At the new point, the ECU sets the air-to-fuel ratio to a lean condition and checks the temperature. In this instance, there has been no fuel shutoff detected and the critical temperature for the NOx adsorber has not been reached. Therefore, no rich exposure is required as the NOx adsorber requires no reduction function regeneration.

Scenario 2 (Point B to B1)—Fast Deceleration From High Speed: This scenario might be experienced during expressway type driving when the engine is operating at very high speed. The engine map at point B calls for a stoichiometric air-to-fuel ratio setpoint, and the critical temperature, in this case $T_7$, is surpassed. Consider the case where the vehicle must slow down very quickly because of slow traffic ahead. Here, we consider the case of a hard deceleration to point B1, for example. The ECU determines that the deceleration is fast and executes a fuel shutoff. This, in conjunction with the critical temperature flag triggers a rich fuel spike immediately following the termination of the fuel shutoff. When the air-to-fuel ratio setpoint is changed to a lean condition at point B1, the adsorber reduction function will be regenerated and ready to accept decomposed NOx during the adsorber regeneration step.

Scenario 3 (Point B to B2)—Slow Deceleration From High Speed: This scenario might also be experienced during Autobahn type driving. Here, the driver slows gradually, for example, when approaching a thickly settled area. Even though the critical temperature flag is set, the deceleration is slow and a fuel shutoff is not triggered. There is no need to regenerate the NOx reduction function, so no fuel spike is triggered.

Scenario 4 (Point B to C) and (Point D to C)—Deceleration to Idle: This scenario could occur under high speed, expressway type driving, for example approaching a toll booth, or an exit ramp. In the case of point B, the critical temperature flag has been set while for point D it has not. In each instance, the deceleration to point C is hard and a fuel shutoff strategy will be implemented. For the B to C deceleration, the rich spike reduction function regeneration will occur because the critical temperature flag has been triggered. For the D to C deceleration the rich spike will not be imposed following the fuel cut if the critical temperature is $T_7$, but it will if the critical temperature is $T_6$.

Scenario 5 (Point C to C1 to C2)—Acceleration from Idle: This scenario occurs from a stop. The driver puts the gas pedal to the floorboards from idle, accelerates to a particular speed, shifting through the gears to reach a cruise mode speed and load setting at point C2. Here, there is no fuel shutoff as the change in speed/load point occurs by shifting of gears. Therefore, there is no need to impose the rich regeneration spike.

Thus one skilled in the art would be able to envision an engine control unit comprising an engine map that defines a region of engine operation that once entered and exited after a fuel-cut or quick engine deceleration (i.e., a rate of engine deceleration greater than a predetermined amount) is detected, a signal is generated to activate means for providing a fuel spike to regenerate the rhodium component of the catalyst. The region would be defined by the area encompassed by $\lambda>1$ and T (inlet catalyst temperature) greater than a predetermined value which is hereinafter more fully described. Values in the engine map or measured values for engine speed and engine load could also be used to detect a quick engine deceleration or fuel cut by means known in the art.

Figure 2A:
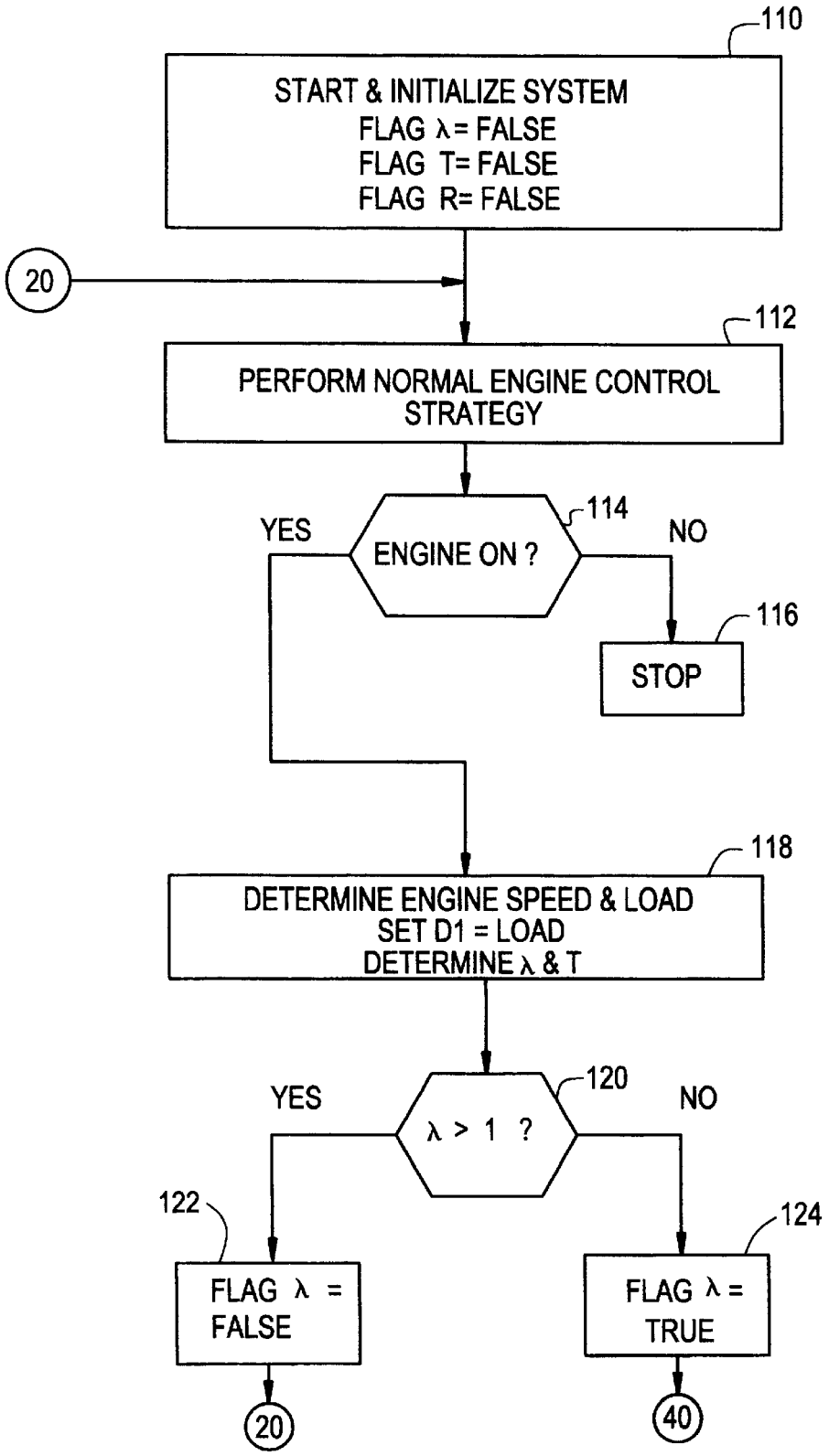
FIG. 2A and FIG. 2B depict an illustrative control alogrithm characteristic of the present invention.
Figure 2B:
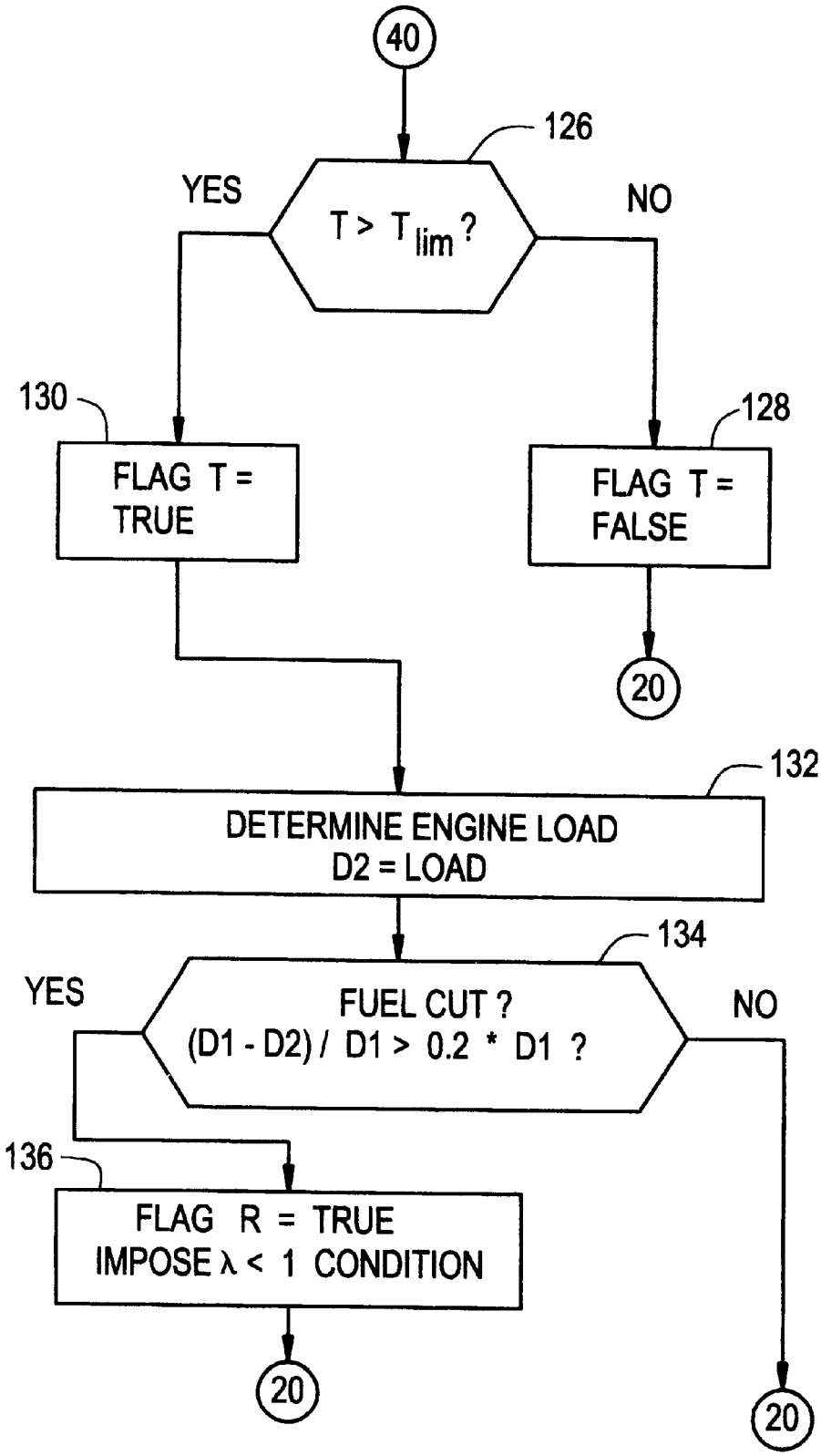

An example of a suitable control strategy embodying the present invention is shown in FIGS. 2A and 2B. As would be apparent to one skilled in the art, the algorithm of FIGS. 2A and 2B is only illustrative and other algorithms may be used in accordance with the present invention. FIGS. 2A and 2B are explained with reference to the following description.

Start and Initialize System (Box 110)—This box sets the following control algorithm flags when an engine is turned on:

FLAG $\lambda$=FALSE—this flag references the air-to-fuel ratio, $\lambda$.

FLAG T=FALSE —this flag references the temperature at the NOx catalyst inlet.

FLAG R=FALSE—this flag references when the NOx catalyst regeneration is to be performed.

Perform Normal Engine Control Strategy (Box 112)—This box utilizes the existing engine control strategy of an engine. For example, under a typical lean-NOx control strategy, Box 112 functions to operate the engine under lean conditions with periodic rich-condition operation as needed to regenerate the NOx trapped in the NOx catalyst. An example of such an engine control strategy is given in EP 560,991 the disclosure of which is incorporated by reference.

Engine On? (Box 114)—This box checks that the engine is running. If the engine is not running, the control algorithm is exited i.e., go to Box 116—STOP. If the engine is running, go to Box 118.

Determine Engine Speed & Load (Box 118)—This box determines the engine speed and load. Engine speed may be determined simply by getting a reading of the engine rpm. Engine load can be determined by a measurement of the exhaust manifold pressure which is correlatable to engine load. Once the engine load is determined, flag D1 is set equal to the value of the load. Values for $\lambda$ and T are next determined. X may conveniently be determined by a data table in the ECU. T may be determined by a measurement of the temperature at the NOx catalyst inlet or by a data table in the ECU. Alternately, both $\lambda$ and T values previously could have been determined and recalled from various engine speed/load points and thus does not have to be "re-determined". Once $\lambda$ and T are determined, go to Box 120.

$\lambda>1$? (Box 120)—This decision box determines whether the value for $\lambda$ found in Box 118 is representative of lean-condition operation (i.e., $\lambda>1$) or of rich-condition operation (i.e., $\lambda<1$). If $\lambda$ is not greater than 1, the engine is operating under the rich or stoichiometric condition, so there is no need to impose a rich-fuel spike. Therefore, the algorithm returns to the control algorithm at point 20 and continues until a $\lambda>1$ condition is measured. When a $\lambda>1$ condition is measured, FLAG $\lambda$=TRUE (Box 124) because a lean-condition has been measured. The algorithm then goes on to Box 126.

$T>T_{lim}$? (Box 126)—This box determines whether the measured temperature of Box 118 has exceeded a preset temperature limitation, $T_{lim}$. $T_{lim}$ represents a temperature indicative of when the performance of a rhodium-containing catalyst under lean-condition operation has deteriorated to an unacceptable level. Thus, $T_{lim}$ will vary, as it may be set at a temperature based on a measurement or calculation where the catalyst conversion rate drops below a predetermined minimum. For example, one particular catalyst has been observed to give 90% NOx conversion at approximately 500° C. and 80% NOx conversion at approximately 650° C. However, one skilled in the art would appreciate that $T_{lim}$ may vary due to a number of things such as NOx catalyst compositional factors (e.g., differences in amount and type of support material used, etc.) or pollutant level of the engine exhaust gas. Also, $T_{lim}$ may vary as a design criteria. In this instance, the designer of the control algorithm may assign $T_{lim}$ a temperature value where the NOx catalyst performance has been determined or is expected to drop to 80% of the catalyst's initial, unaged conversion rate or when the catalyst reaches an absolute conversion rate (e.g., 80% NOx conversion). Of course, other catalyst conversion rate values may be used such as 90%, 95%, etc., to determine the temperature where the $T_{lim}$ limitation will be met to reactivate the catalyst. Thus if T is not greater than $T_{lim}$, the algorithm sets FLAG T=FALSE in Box 128 and returns to the algorithm at point 20 until both the $\lambda>1$ condition and $T>T_{lim}$ condition are met. When both of the foregoing conditions are met, Box 130 is entered and FLAG T is set equal to TRUE and the algorithm proceeds to Box 132.

Determine Engine Load (Box 132)—This box makes another determination of the engine load similar to the determination made in Box 118.l The new engine load value is recorded as D2. Once D2 has been set, the algorithm continues to Box 134.

Fuel Cut? (Box 134)—This box determines whether a fuel cut has occurred. Such a condition would occur during a deceleration of an automobile. In the particular instance shown in the algorithm, when the difference of D1 and D2 divided by the value of D1 is greater than 0.2*D1, a fuel cut is determined to have occurred. Therefore, FLAG R=TRUE and a fuel-rich condition ($\lambda<1$) is imposed to reactivate the rhodium-containing catalyst. Once reactivated, the algorithm returns to point 20. If the fuel-cut condition is not met, the algorithm returns to point 20 of the algorithm.

It will be appreciated by those skilled in the art that the foregoing basic control algorithm may be optimized. For example, the fuel-cut condition may be determined by a number of other means such as receiving a signal directly that the fuel injector has been closed, measuring a velocity differential in the automobile, measuring and correlating exhaust manifold pressure differentials, or by other means known in the art that are indicative of rapid deceleration. Other methods include measuring the throttle valve position and engine speed (rpm) (U.S. Pat. No. 4,434,769); measuring the throttle valve position, intake air pressure, and engine rpm (U.S. Pat. No. 4,491,115); and using an accelerator petal position sensor, engine rpm and brake application sensor (U.S. Pat. No. 4,539,643) the disclosures of which are incorporated by reference.

Furthermore, the present invention may be used with a wide variety of rhodium-containing catalysts. Such rhodium-containing catalysts may further comprise other precious metals such as platinum and palladium; NOx storage components containing alkaline earth metals, rare earth metals, and alkali metals; and support materials of alumina, zeolite, zirconia, silica-alumina, silica, and their combinations. Representative of such catalysts are those described in EP 669 157 the disclosure of which is hereby incorporated by reference.

EXAMPLES

The following examples demonstrate the viability and advantages of providing rich pulses on the effectiveness of rhodium-containing catalysts for reducing NOx under partial-lean conditions.

Exhaust Gas Simulation

Several catalysts were prepared and tested under partial-lean conditions using the following gas simulation experiment procedure altered between rich and lean operation:

| | |
|---|---|
| Space Velocity = | 25,000 $hr^{-1}$ |
| Cycle: $\lambda$ = | 1.3 (duration: 60 sec) (Lean) |
| $\lambda$ = | 0.9 (duration: 6 sec) (Rich) |
| Composition: $H_2O$ = | 10% |
| $CO_2$ = | 10% |
| $O_2$ = | 4.5% (Lean); 0.08% (Rich) |
| CO = | 0% (Lean); 4.4 (Rich) |
| NOx = | 500 ppm |
| $SO_2$ = | 10 ppm |

The actual values used as data point for determining catalyst performance was average NOx conversion for 5 lean/rich cycles at a fixed inlet temperature to the NOx catalyst.

Rhodium-Containing Catalyst Description

Two catalysts were prepared for evaluation. Catalyst-1 ("C-1") contained a rhodium-loading of approximately 15 g/ft$^3$ and catalytic and NOx trapping effective amounts of platinum and barium supported on alumina. Catalyst-2 ("C-2") contained a rhodium-loading of approximately 10 g/ft$^3$ and catalytic and NOx trapping effective amounts of platinum and barium supported on alumina.

The foregoing catalysts where subjected to the following treatments to simulate aging of the catalyst:

| | |
|---|---|
| Stoichiometric Aging: | 12 hrs under gas stream containing 10% $H_2O$/90% Nitrogen at 750° C. or 850° C. (as specified). |
| Lean Aging: | 12 hrs under stream containing 10% $H_2O$/90% Air at 750° C. or 850° C. (as specified). |

Regeneration of the catalyst was simulated by taking the lean-aged catalyst then subjecting the catalyst to the following condition:

| | |
|---|---|
| Lean-Aged Regeneration: | 1 hr under gas stream containing 7% $H_2$/93% Nitrogen at 650° C. |

Figure 3:
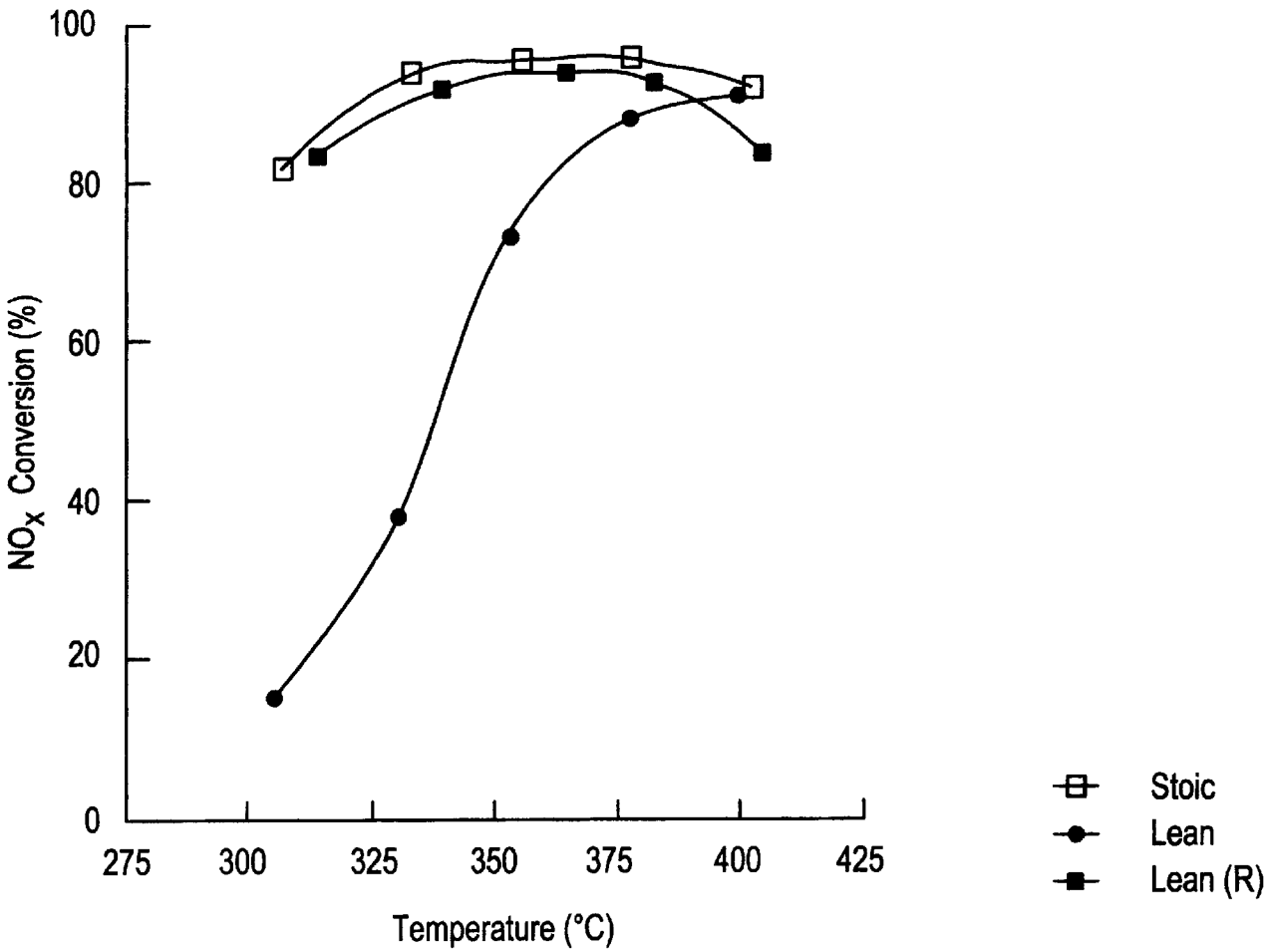
FIG. 3 depicts performance of a first rhodium-containing catalyst having been aged at 750° C. under conditions simulating high temperature stoichiometric operation, high temperature lean-operation, and high temperature lean followed by regeneration operation.

The performance of the catalysts having been exposed to the foregoing treatments were evaluated under the exhaust gas simulation experiment outlined above. Specifically FIG. 3 represents performance of the C-1 catalyst having been aged at 750° C. under stoichiometric ("Stoic") and lean ("Lean") aging conditions. FIG. 3 further represents performance of catalyst C-1 having been lean aged and then subjected to the regeneration treatment ("Lean (R)") as noted above. Referring to FIG. 3, one clearly sees the advantages of this invention as the "Lean (R)" curve more closely resembles the "Stoic" operation. Thus, substantially similar performance can be achieved under partial-lean cycling conditions as that achievable under stoichiometric operating conditions with the benefits fuel savings of partial-lean operation versus stoichiometric operation.

Figure 4:
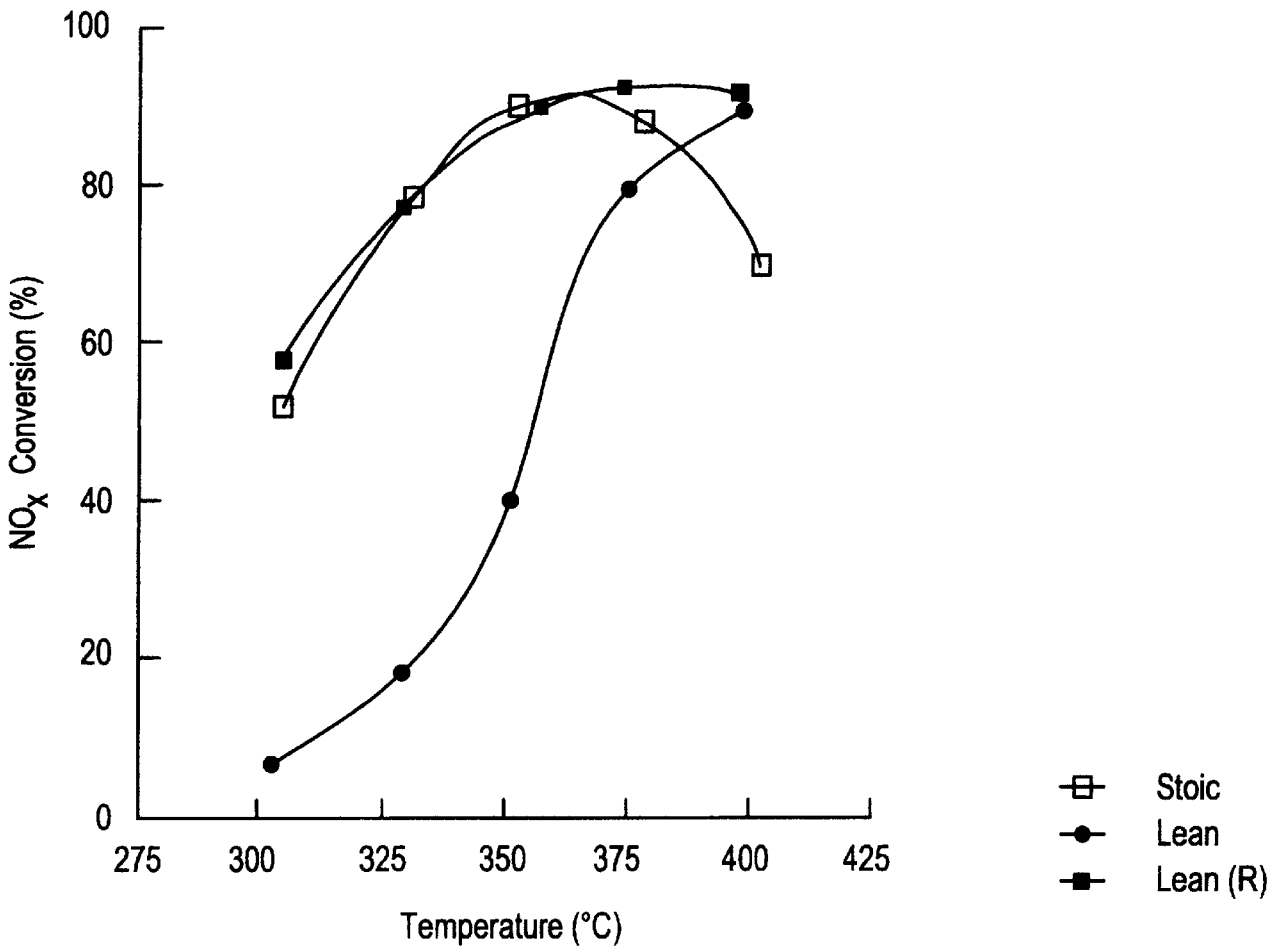
FIG. 4 depicts performance of a first rhodium-containing catalyst having been aged at 850° C. under conditions simulating high temperature stoichiometric operation, high temperature lean-operation, and high temperature lean followed by regeneration operation.

FIG. 4 represents catalyst C-1 performance after aging conditions at 850° C. instead of 750DC as was done for FIG. 3. Again as in FIG. 3, the "Lean (R)" treatment representative of the present invention more closely resembles performance of "Stoic" operation as compared to "Lean" operation.

Figure 5:
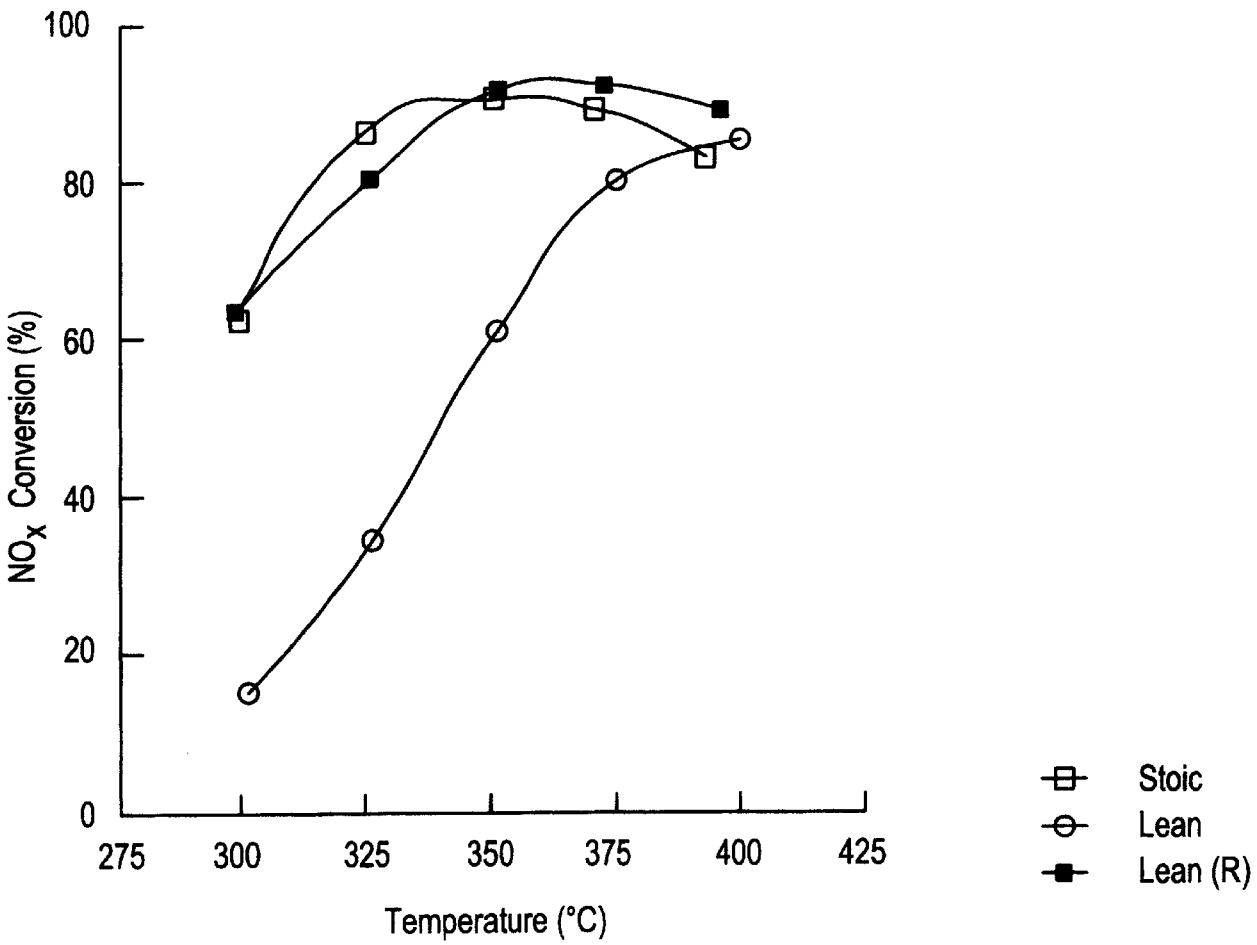
FIG. 5 depicts performance of a second rhodium-containing catalyst having been aged at 750° C. under conditions simulating high temperature stoichiometric operation, high temperature lean-operation, and high temperature lean followed by regeneration operation.

FIG. 5 represents catalyst C-2 performance after aging conditions of 750° C. similar to what was done for catalyst C-1 in FIG. 3. Referring to FIG. 5, again one sees that the "Lean (R)" operation representative of the present invention most closely resembles stoichiometric "Stoic" operation and even out performs "Stoic" operation at temperatures in the range of 350° C. and higher.

Thus, it should be apparent to one skilled in the art, that performance of rhodium-containing catalysts, particularly rhodium-containing catalysts subject to partial-lean burn conditions and severe aging, can perform closer or even exceed performance of the catalyst under stoichiometric operation by being subjected to rich treatment after being exposed to severe aging conditions.

While specific embodiments of the present invention are described in detail herein, they are illustrative in nature, and the scope of the present invention is defined in the claims that follow. Modifications to the illustrated embodiments will occur to those skilled in the art upon a reading of the accompanying disclosure. Such odifications are also intended to be included within the cope of the accompanying claims.

What is claimed is:

1. An engine control unit that comprises an engine map which defines a region of engine operation that once entered and exited after a fuel cut or rate of engine deceleration greater than a predetermined amount, and that generates a signal to activate means for providing a rich-fuel spike to regenerate the rhodium component of rhodium-containing catalyst.

2. The engine control unit of claim 1, wherein the region is defined by a temperature greater or equal to a predetermined temperature and $\lambda$ not greater than 1.

3. The engine control unit of claim 2, wherein the predetermined temperature corresponds to a previously measured or calculated catalyst performance level.

4. The engine control unit of claim 3, wherein the predetermined temperature corresponds to a catalyst performance level equal to 80% of the initial, unaged catalyst performance.

5. A system for controlling pollutant levels from an engine periodically or substantially operating in a lean-burn mode and comprising a rhodium-containing catalyst, the system comprising:

(a) means for determining a fuel cut;

(b) means for determining an inlet temperature to the catalyst;

(c) means for determining $\lambda$;

(d) means for injecting a fuel or hydrocarbon to create a fuel-rich environment at the catalyst inlet to regenerate the rhodium component of the rhodium-containing catalyst after determining a fuel cut, an inlet temperature to the catalyst equal to or greater than a preselected temperature, and $\lambda$ greater than 1.

6. The system of claim 5, wherein the means for determining a fuel cut comprises measuring the engine throttle valve position and engine speed.

7. The system of claim 6, wherein the means for determining a fuel cut further comprises measuring the engine intake air pressure.

8. The system of claim 5, wherein the means for determining a fuel cut comprises using an accelerator pedal position sensor, measuring engine speed, and using a brake application sensor.

9. A method for reactivating the $NO_x$ conversion performance of a rhodium-containing catalyst disposed in the exhaust gas stream of an engine, the method comprising:

monitoring fuel consumption of the engine;

monitoring the temperature of the catalyst; and creating fuel-rich conditions in the gas stream after determining that the catalyst has attained a predetermined temperature of at least 500° C. and that the engine has experienced a fuel cut or quick deceleration.

10. The method of claim 9, wherein the catalyst further comprises at least one of platinum, palladium, and an alkaline earth metal.

11. The method of claim 10, wherein the catalyst further comprises a rare earth metal, an alkali metal, or mixtures thereof.

12. A method for reactivating the $NO_x$ conversion performance of a rhodium-containing catalyst disposed in the exhaust gas stream of an engine, the method comprising:

monitoring the fuel consumption of the engine;

monitoring the temperature of the catalyst; and creating fuel-rich conditions in the gas stream after determining that the temperature of the catalyst has changed from a predetermined temperature of at least 500° C. to a temperature below the predetermined temperature and that that the engine has experienced a fuel cut or quick deceleration.

13. A method for reactivating the $NO_x$ conversion performance of a rhodium-containing catalyst disposed in the exhaust gas stream of an engine, the method comprising:

monitoring the lambda ratio ($\lambda$) of the exhaust gas;

monitoring the temperature of the catalyst; and creating fuel-rich conditions in the gas stream after determining that the catalyst has attained a predetermined temperature of at least 500° C. and that $\lambda$ has changed from $\lambda \leqq 1$ to $\lambda > 1$.

14. A method for reactivating the $NO_x$ conversion performance of a rhodium-containing catalyst disposed in the exhaust gas stream of an engine, the method comprising:

monitoring the lambda ratio ($\lambda$) of the exhaust gas;

monitoring the temperature of the catalyst; and creating fuel-rich conditions in the gas stream after determining that the temperature of the catalyst has changed from a predetermined temperature of at least 500° C. to a temperature below the predetermined temperature and that $\lambda$ has changed from $\lambda \leqq 1$ to $\lambda > 1$.

15. The method of claim 9, claim 12, claim 13 or claim 14 comprising selecting a desired conversion rate for the catalyst, monitoring catalyst conversion performance, and assigning the predetermined temperature to a temperature at which the conversion performance fails to meet the desired conversion rate.

16. The method of claim 15 wherein selecting a desired conversion rate comprises determining the initial conversion rate of the unaged catalyst, selecting a desired proportion of the initial conversion rate and setting the desired conversion rate as the product of the desired proportion of the initial conversion rate.

17. The method of claim 16 wherein the desired proportion is 80% of the initial conversion rate.

* * * * *